US005729940A

United States Patent [19]

Bullivant

[11] Patent Number: 5,729,940

[45] Date of Patent: Mar. 24, 1998

[54] STRUCTURAL BEAM FOR USE IN FLOORING SYSTEM

[75] Inventor: Roger A. Bullivant, Burton-on-Trent, England

[73] Assignee: Roger Bullivant of Texas, Inc., Grand Prairie, Tex.

[21] Appl. No.: 544,432

[22] Filed: Nov. 17, 1995

[51] Int. Cl.[6] ..... E02D 27/02

[52] U.S. Cl. ..... 52/299; 52/293.1; 52/405.1; 52/745.05; 52/745.13

[58] Field of Search ..... 52/244, 242, 294, 52/299, 293.1, 169.1, 250, 251, 322, 741.1, 741.41; 405/229

[56] References Cited

U.S. PATENT DOCUMENTS

| | | | |
|---|---|---|---|
| 4,998,393 | 3/1991 | Baena | 52/274 X |
| 5,217,326 | 6/1993 | Bullivant | 405/233 |
| 5,526,623 | 6/1996 | Bullivant | 52/338 |

FOREIGN PATENT DOCUMENTS

| | | | |
|---|---|---|---|
| 0528578 | 2/1993 | European Pat. Off. . | |
| 362912 | 9/1938 | Italy | 52/322 |
| 429604 | 6/1948 | Italy | 52/322 |
| 362247 | 12/1931 | United Kingdom . | |
| 570665 | 7/1945 | United Kingdom | 52/322 |
| 2274666 | 8/1994 | United Kingdom | 52/292 |

*Primary Examiner*—Michael Safavi
*Attorney, Agent, or Firm*—Sidley & Austin

[57] ABSTRACT

A structural beam has a generally T-shaped cross-sectional profile with a column portion and a capital portion. The capital portion has a top surface and downwardly and inwardly converging sidewalls, while the column portion has downwardly and inwardly converging sidewalls and a bottom surface, with the rate of convergence of the capital portion being greater than the rate of convergence of the column portion. Such beam can be employed as a floor beam in a flooring system for a building structure, wherein the ends of a plurality of such floor beams are supported by the inner flanges on opposed foundation beams having an inverted T-shaped profile. The foundation beams can be positioned end-to-end to form shuttering for an in situ cast concrete slab. A layer of a thermal insulating material can be positioned on top of the floor beams, and a concrete slab can be cast on top of the insulating layer such that the top of the concrete slab is no higher than the top of the foundation beams.

21 Claims, 2 Drawing Sheets

FIG. 1
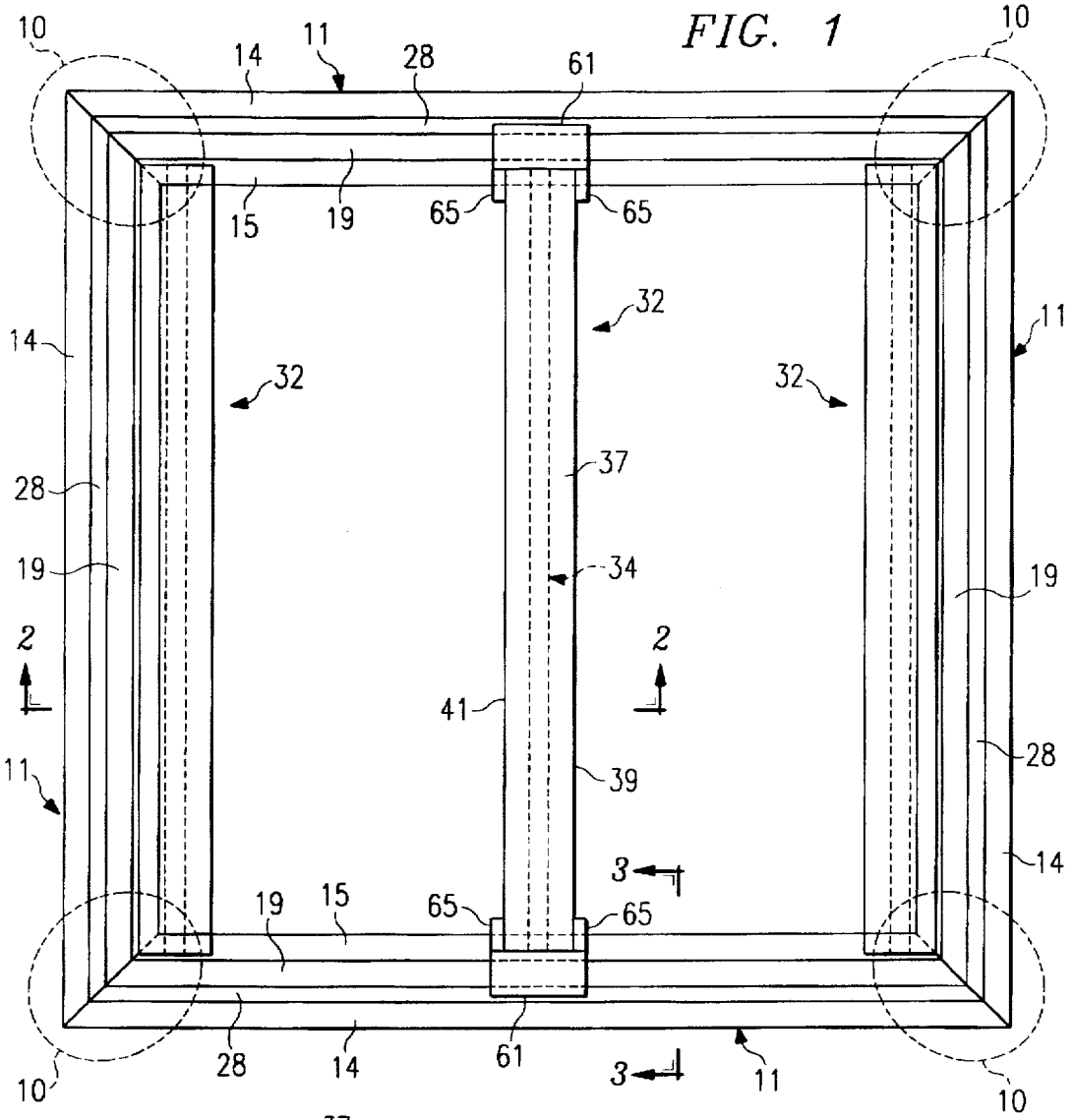
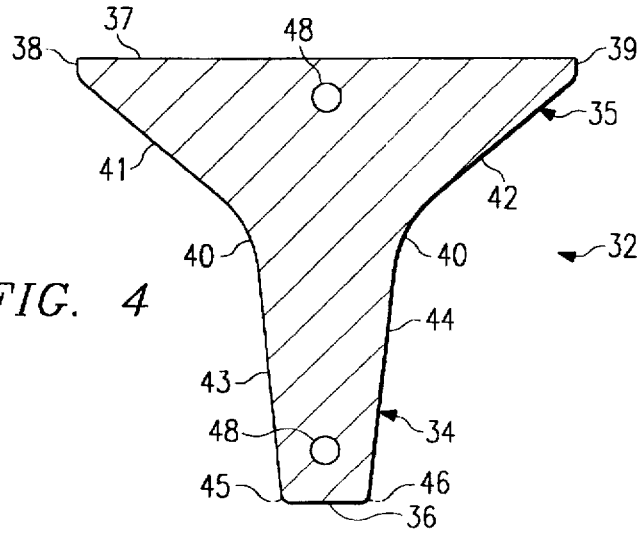
FIG. 4

STRUCTURAL BEAM FOR USE IN FLOORING SYSTEM

FIELD OF THE INVENTION

The present invention relates to a structural beam and to a structural system incorporating the structural beam. In a particular aspect, the invention relates to a structural beam for use in creating a flooring system for a building structure, and to the resulting flooring system.

BACKGROUND OF THE INVENTION

European Patent Application Publication 0528578 A1 discloses a support structure for a building in which a plurality of support members, for example, piles, are placed substantially vertically in the ground and the gaps between the tops of adjacent pairs of the piles are spanned by prefabricated reinforced concrete structural beams on which the walls of the structure are built and the floor structure is supported.

The floor structure described in European Patent Application Publication 0528578 A1 is fabricated from a plurality of floor beams, with the gaps between each adjacent pair of floor beams being filled with flooring blocks. The beams and blocks are then covered by a screed, which is spread over the top of the beam and block structure after assembly.

An alternative method of assembling a flooring system which, in a number of instances, exhibits certain advantages, comprises casting a reinforced concrete floor slab in situ, with the foundation beams resting on the piles defining the periphery of the building structure and acting as shuttering for the floor slab. The floor slab can be of any convenient construction. It can rest on the ground within the structure and can include, as desired, reinforcing elements, heating elements, service ducts, etc.

After detailed research and experimentation, it has been realized that a building structure is more efficient if the peripheral foundation beams and the floor structure act as a monolithic mass. Thus, it is important that there is good mechanical interconnection between the foundation beams and the floor slab.

Proposals have been put forward in the past to achieve a good mechanical interconnection between the foundation beams and the floor slab by providing that reinforcing steel elements within the foundation beams project outwardly from each beam so that the reinforcing steel elements are incorporated into the subsequently cast floor slab. While this proposal is mechanically and structurally sound, it gives rise to certain disadvantages, particularly during the manufacture and placement of the beams.

It is an object of the present invention to obviate or mitigate these and other disadvantages.

SUMMARY OF THE INVENTION

According to one aspect of this invention, there is provided a structural beam which is suitable for use in supporting a flooring assembly, the structural beam comprising a longitudinally extending foot, or column, portion and a longitudinally extending head, or capital, portion. The structural beam has a generally T-shaped cross-sectional profile in a plane perpendicular to the length of the structural beam such that the profile of the capital portion is wider than the profile of the column portion. The capital portion has a top surface and downwardly and inwardly converging sidewall surfaces, while the column portion has downwardly and inwardly converging sidewall surfaces and a bottom surface, with the rate of convergence of the capital portion being greater than the rate of convergence of the column portion. Such beam can be employed as a floor beam in a flooring arrangement for a building structure, wherein the ends of a plurality of such floor beams are supported by the inner flanges of opposed foundation beams having an inverted T-shaped cross-sectional profile in a plane perpendicular to the length of the foundation beam.

According to another aspect of the present invention, there is provided a flooring structure comprising first and second foundation beams adapted to be arranged opposite each other, and first and second floor beams adapted to extend between the first and second foundation beams. Each of the foundation beams can be in the form of an inverted T-shaped beam comprising a longitudinally extending upstanding web, or column, and a longitudinally extending flange, or base portion, located at the bottom of the upstanding web and extending transversely of the upstanding web. Each end of the first and second floor beams can be supported by a flange of a respective foundation beam. Each floor beam provides an upwardly facing surface, which is positioned below the tops of the foundation beams to support a flooring assembly thereon, the flooring assembly having an upper surface positioned no higher than the tops of the foundation beams. Preferably, each floor beam has a substantially T-shaped cross-sectional profile in a plane perpendicular to the length of the floor beam, the profile having a longitudinally extending head, or capital, portion and a longitudinally extending foot, or column, portion, with the capital portion having a width which is greater than the width of the column portion. Preferably, the upwardly facing surface which is provided by each floor beam is the upper surface of the capital portion.

A holder can be provided to maintain a floor beam upright during the construction of the flooring system. A suitable holder comprises a clip which is adapted to engage the column portion of the floor beam. Preferably the clip comprises two clip fingers, arranged on opposite sides of a floor beam, and a bridging member linking the two clip fingers so that the clip fingers resiliently engage the floor beam. Another suitable holder comprises a generally inverted U-shaped hook for securing the holder on the top end of an upstanding web of a foundation beam, wherein the hook has a leg extending downwardly alongside an inner sidewall of that foundation beam, and a pair of generally horizontally extending lugs connected to the leg and spaced apart from each other so that the end of a floor beam can be accommodated therebetween to stabilize that floor beam during subsequent construction of the flooring system.

The flooring assembly can include a layer of thermal insulating material arranged on and supported by the upwardly facing surfaces of the floor beams. Preferably, the thermal insulating material is a polymeric thermoplastic foamed material, e.g., expanded polystyrene. The flooring assembly can also include a concrete layer cast in situ on top of the floor beams or on top of the layer of the thermal insulating material. Reinforcing fibers can be included in the concrete mix from which the concrete layer is cast. Alternatively, the concrete layer can be preformed before being disposed on top of the floor beams or on top of the layer of thermal insulating material. The concrete layer can be provided with conduits, for example, central heating pipes, and the layer of thermal insulating material can be interrupted in the region of such conduits in order to provide for a continuation of the concrete layer about each conduit.

BRIEF DESCRIPTION OF THE DRAWINGS

FIG. 1 is a plan view of a floor system comprising a plurality of prefabricated, steel reinforced, concrete beams serving as the outer foundation beams for a building structure and a plurality of floor beams positioned between an opposite pair of the foundation beams, with the flooring assembly omitted for clarity;

FIG. 4 is a cross-sectional view of a floor beam in a plane perpendicular to the length of the floor beam.

DETAILED DESCRIPTION

Figure 2:
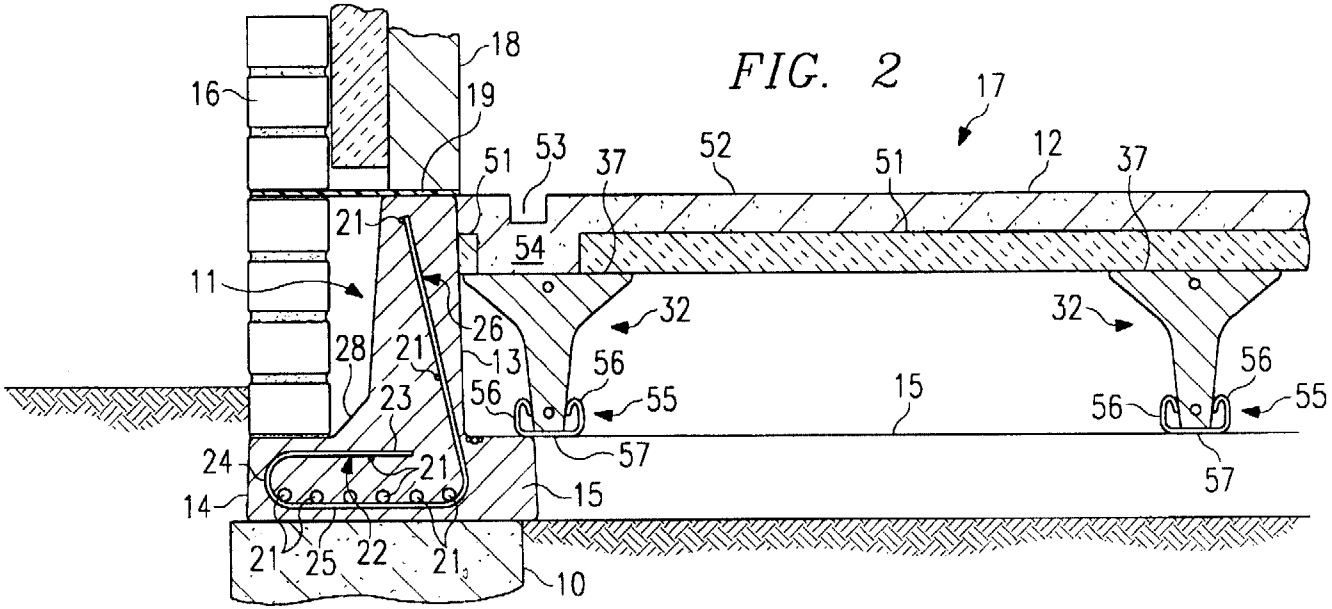
FIG. 2 is a cross-sectional view, taken along line 2—2 of FIG. 1.

Referring to FIGS. 1 and 2, the building support structure comprises a plurality of support members, e.g., piles or piers 10, which are placed substantially vertically in the ground at spaced apart intervals around the periphery of the building site, and a plurality of structural beams 11, with each structural beam 11 spanning a gap between the top portions of an adjacent pair of the support members 10 so that the structural beams 11 serve as foundation beams and extend horizontally in an end-to-end relationship to define the periphery of the building structure to be built. This arrangement of foundation beams 11 serves as shuttering in which the floor slab 12 can be cast in situ.

Each foundation beam 11 is a reinforced concrete beam, which has been prefabricated under factory conditions, having an inverted T-shaped cross-sectional profile in a plane perpendicular to the length of the foundation beam 11. Each foundation beam 11 comprises a longitudinally extending upstanding, or vertical, web or column portion 13 and a longitudinally extending generally horizontal web or base formed by the outer flange 14 and the inner flange 15 extending generally horizontally outwardly from opposite longitudinal sides of the bottom of the column portion 13. The horizontal thickness of the column portion 13, viewed in a plane perpendicular to the length of the foundation beam 11, decreases in the upward direction, while the upper and lower faces of the flanges 14 and 15 are substantially horizontal. The top surface of the longitudinally extending outer flange 14 supports the outer skin 16 of a wall built on the foundation beam 11, while the top surface of the longitudinally extending inner flange 15 supports the floor assembly 17, described in greater detail below. The inner skin 18 of the wall is supported on the longitudinally extending top surface 19 of the column portion 13 of the foundation beam 11. A damp proof membrane, e.g., a thermoplastic polymeric film, 20 can be positioned between the top of the foundation beam 11 and the inner skin 18. A beam of this general configuration is described in European Patent Application Publication No. 0528578 A1 for use with a floor slab which is assembled in situ.

Each foundation beam 11 can contain a plurality of longitudinally extending reinforcement elements, e.g., steel wires or rods, 21, at least some of which can be pretensioned while the foundation beam 11 is being cast, with some of the reinforcing elements 21 being positioned in the horizontal base of the foundation beam 11 and some being positioned in the column portion 13. Vertically extending reinforcing links 22 can be provided at spaced intervals along the length of the foundation beam 11. Each illustrated link 22 comprises a first horizontal section 23, a curved vertical section 24, a second horizontal section 25, and a generally vertical section 26. The first horizontal section 23 extends horizontally from approximately the center of the base of the foundation beam 11 to the upper end of the curved section 24, which is located in the outer end portion of the outer flange 14. The second horizontal section 25 extends from the lower end of the curved section 24 to the lower end of the generally vertical section 26, which extends upwardly into the column portion 13. The foundation beam 11 can be formed with a reinforcing fillet 28 at the junction of the column portion 13 and the outer flange 14.

In the illustrated embodiment, a first one and a second one of the foundation beams 11 are positioned so as to be opposite each other, while a third one and a fourth one of the foundation beams 11 are positioned so as to be opposite each other, with the four foundation beams 11 being positioned in an end-to-end arrangement. While the illustrated embodiment is in the form of a rectangular arrangement with the first and second foundation beams 11 being parallel to each other and the third and fourth foundation beams 11 being parallel to each other, it is not necessary that the opposing foundation beams 11 be strictly parallel to each other, as the invention is applicable to other configurations, e.g., a triangular configuration, a pentagonal configuration, etc., so long as the opposing foundation beams 11 can support the opposite ends of a floor beam 32. While the illustrated embodiment has four foundation beams 11, any suitable number of foundation beams 11 can be utilized to form the desired foundation outline. While the illustrated foundation beams 11 have mitered ends to form a right angle between two adjacent foundation beams, the ends of the foundation beams 11 can be shaped as necessary to form an L-shaped, T-shaped, or X-shaped Junction at a right angle or at any other desired angle. The adjacent ends can be merely positioned in place, or they can be Joined together by an adhesive, e.g., an epoxy, or by a suitably shaped connector member.

Figure 3:
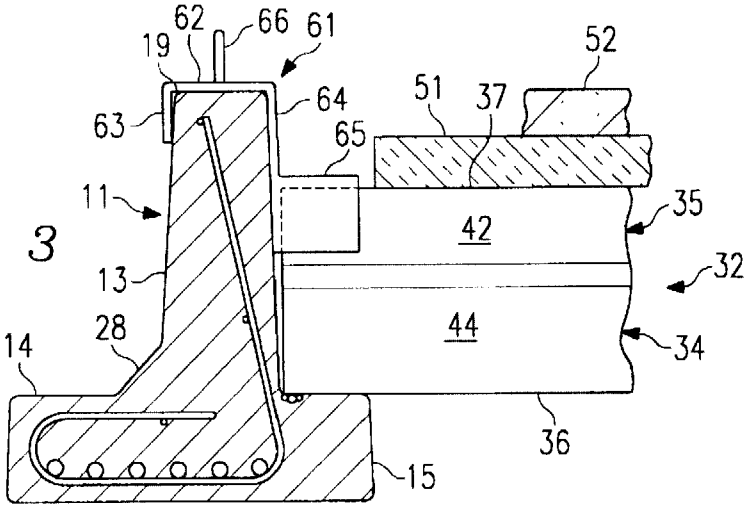
FIG. 3 is a cross-sectional view, taken along line 3—3 of FIG. 1.

Referring to FIGS. 1–3, the floor structure includes a plurality of floor beams 32, with each of the floor beams 32 extending from the first one of the foundation beams 11 to the opposing second one of the foundation beams 11 so that the end portions of each of the floor beams 32 is supported by the top surfaces of the inner flanges 15 on the first and second ones of the foundation beams 11. The vertical height of each of the floor beams 32 is less than the vertical height of the column portion 13 of the foundation beams 11, so that the top of each of the floor beams 32 is an upwardly facing surface 37 which is positioned below the top surfaces 19 of the foundation beams 11. The floor beams 32 are generally arranged so as to be parallel to each other, but other relationships can be employed. In the illustrated embodiment, a plurality of floor beams 32 extends between the flanges 15 of a pair of opposed foundation beams, with the floor beams 32 being parallel to each other and equally spaced apart from each other.

Referring to FIG. 4, each floor beam 32 has a generally T-shaped cross-sectional profile in a plane perpendicular to the length of the floor beam 32 and is preferably symmetrical about its central longitudinally extending mid-plane. Each floor beam 32 comprises a longitudinally extending generally vertical column portion 34 and a longitudinally extending generally horizontal capital portion 35. The bottom surfaces 36 of the longitudinal ends of a column portion 34 are positioned on the inner flanges 15 of opposing foundation beams 11, so that the floor beam 32 is supported by the pair of foundation beams 11. The capital portion 35 has a top longitudinally extending surface 37 with first and second longitudinally extending edges 38 and 39. The capital portion 35 has first and second longitudinal sidewall surfaces 41 and 42 extending downwardly from the first and second longitudinally extending edges 38 and 39, respectively, and inwardly to a bottom 40 of the capital portion 35 so as to converge toward each other so that a width of the bottom 40 of the capital portion 35 perpendicular to the length of the floor beam 32 is less than a width of the top surface 37 perpendicular to the length of the floor beam 32. The column portion 34 has third and fourth longitudinal sidewall surfaces 43 and 44 extending downwardly from the first and second longitudinally extending sidewall surfaces 41 and 42, respectively, to the longitudinal edges 45 and 46 of the longitudinally extending bottom surface 36 so as to converge toward each other so that a width of the longitudinally extending bottom surface 36 perpendicular to the length of the floor beam 32 is less than the width of the bottom 40 of the capital portion 35 perpendicular to the length of the floor beam 32. The first and second longitudinal sidewall surfaces 41 and 42 of the capital portion 35 have a rate of convergence which is greater than the rate of convergence of the third and fourth longitudinal sidewall surfaces 43 and 44 of the column portion 34, i.e., the angle between the sidewall 41 and the sidewall 42 in a plane perpendicular to the length of the floor beam 32 is greater than the angle between the sidewall 43 and the sidewall 44 in the plane perpendicular to the length of the floor beam 32, such that the width of the top surface 37 is greater than the width of the bottom surface 36 by a factor of at least three. The vertical height of the capital portion 35 constitutes approximately thirty to forty percent of the overall vertical height of the floor beam 32. The longitudinally extending top surface 37 and the longitudinally extending bottom surface 36 are at least substantially parallel to each other. Each of the sidewalls 41, 42, 43, and 44 can be substantially planar with the merger of each upper sidewall 41 or 42 into the respective lower sidewall 43 or 44 being in the form of a smooth curve. Each floor beam 32 can be provided with longitudinally extending reinforcing members 48, e.g., in the form of steel wires or rods.

Referring to FIGS. 2 and 3, the top surface 37 is substantially flat so that a flooring assembly 17 can be arranged thereon and supported thereby. The flooring assembly 17 can be in any desired form, but preferably comprises at least one layer 51 of insulating material and a concrete slab 52. The insulating layer 51 can be formed from sheets of a thermal insulating material, e.g., a foamed polystyrene, of a size so as to span the gap between adjacent floor beams 32, with the sheets being positioned on top of the floor beams 32 to form the insulating layer 51. Concrete, which can include reinforcing fibers, can then be cast in situ on top of the insulating layer 51 to form the floor slab 52. Alternatively, the floor slab 52 can be preformed before being positioned on top of the insulating layer 51. Service ducts can be provided in the floor slab 52, for example, a conduit 53, which can be utilized to receive central heating piping, can be formed by removing a portion or all of the thickness of the insulating layer 51 in the area to be occupied by the conduit 53, and concrete can be cast in the resulting space 54 so as to form the floor and walls of the conduit 53 as a continuous portion of the floor slab 52.

The vertical height of the floor beams 32 is sufficiently less than the vertical height of the column portion 13 of the foundation beams 11 so that the insulating layer 51, if present, and the floor slab 52 can be placed in position with the top surface of the floor slab 52 being no higher than the top surface 19 of the foundation beams 11. If desired, the top surface of the floor slab 52 can be below the top surface 19 of the foundation beams 11. Thus, when constructed, the flooring assembly 17 lies wholly within the depth of the foundation beams 11.

In order to construct the floor structure, the foundation beams 11 are initially arranged on the piles 10 and then the floor beams 32 are arranged on the inner flanges 15. In order to prevent the floor beams 32 from tipping over when they are first placed in position, holding devices can be provided for one or more of the floor beams 32. Each of the holders 55 shown in FIG. 2 comprise a pair of clip fingers 56 positioned on opposite sides of a column portion 34 of a floor beam 32 and secured together at their lower ends by an at least substantially planar bridge element 57 which is resting on an inner flange 14, so that the clip fingers 56 resiliently engage the column portion 34 of the floor beam 32 resting on the bridge element 57. The holders 55 can remain in place during and after the construction of the floor structure.

Each of the holders 61, illustrated in FIGS. 1 and 3, comprises a generally inverted U-shaped hook so dimensioned that it can be hooked over the top of the column portion 13 of the foundation beam 11 so that the holder 61 is securely positioned. The hook comprises a horizontal element 62 and generally downwardly extending legs 63 and 64, whereby the horizontal element 62 can rest on the top surface 19 of the foundation beam 11, with the outer leg 63 extending downwardly along the outwardly facing sidewall surface of the column portion 13 of the foundation beam 11 and the inner leg 64 extending downwardly along the inwardly facing sidewall surface of the column portion 13 to a point below the top surface 37 of the floor beam 32. A pair of generally horizontally extending lugs 65 are connected to the inner leg 64, so as to extend away from the column portion 13, and are spaced apart from each other by a distance just greater than the maximum width of the capital portion 35 of the floor beam 32 so that a longitudinal end of a floor beam 32 can be accommodated therebetween to stabilize that floor beam 32 during subsequent construction of the flooring assembly 17. A lifting handle 66 can be provided on the holders 61, so that the holders 61 can be removed after at least a portion of the layer 51 has been positioned on the top surfaces 37 of the floor beams 32, as the frictional forces between the top surfaces 37 and the insulating sheets prevent the floor beams 32 from toppling over. If desired, an adhesive can be applied to the top surfaces 37 prior to the positioning of the insulating layer 51 thereon. The holders 61, which can be formed from sheet steel, can be utilized on one or both ends of a floor beam 32 in addition to or instead of the clip holders 55.

Various other modifications can be made without departing from the scope of the invention.

That which is claimed is:

1. A method of using a structural beam for supporting a flooring assembly, said structural beam having a length and a generally T-shaped cross-sectional profile in a plane perpendicular to said length, said structural beam comprising a longitudinally extending column portion and a longitudinally extending capital portion, said capital portion having a top longitudinally extending surface with first and second longitudinally extending edges, said capital portion having first and second longitudinal sidewall surfaces extending downwardly from said first and second longitudinally extending edges, respectively, and inwardly to a bottom of said capital portion so as to converge toward each other so that a width of said bottom of said capital portion perpendicular to said length is less than a width of said top surface perpendicular to said length, said column portion having third and fourth longitudinal sidewall surfaces extending downwardly from said first and second longitudinally extending sidewall surfaces, respectively, to a bottom longitudinally extending surface, said method comprising:

providing first and second foundation beams arranged opposite each other, each foundation beam having a top surface and at least one flange extending laterally from said foundation beam;

positioning said structural beam with said top longitudinally extending surface of said capital portion facing upwardly to support a floor assembly, said structural beam being positioned to extend from said first foundation beam to said second foundation beam so that said structural beam is supported by said at least one flange on said first and second foundation beams, and said top longitudinally extending surface of said capital portion being positioned below the top surfaces of said first and second foundation beams; and providing a floor assembly supported on said top longitudinally extending surface of said capital portion, said floor assembly having an upper surface positioned no higher than the top surfaces of said foundation beams.

2. A flooring system in accordance with claim 1, wherein each said upwardly facing surface of said capital portion is a top longitudinally extending surface having first and second longitudinally extending edges, said capital portion having first and second longitudinal sidewall surfaces extending downwardly from said first and second longitudinally extending edges, respectively, to a bottom of said capital portion so as to converge toward each other so that a width of said bottom of said capital portion perpendicular to said length is less than a width of said top surface perpendicular to said length;

said column portion having third and fourth longitudinal sidewall surfaces extending downwardly from said first and second longitudinally extending sidewall surfaces, respectively, to a bottom longitudinally extending surface so as to converge toward each other so that a width of said bottom longitudinally extending surface perpendicular to said length is less than said width of said bottom of said capital portion perpendicular to said length.

3. A flooring system in accordance with claim 2, wherein said first and second longitudinal sidewall surfaces have a rate of convergence which is greater than a rate of convergence of said third and fourth longitudinal sidewall surfaces.

4. A flooring system in accordance with claim 2, wherein said top longitudinally extending surface and said bottom longitudinally extending surface are substantially parallel to each other.

5. A flooring system in accordance with claim 2, wherein each of said first, second, third, and fourth longitudinal sidewall surfaces is substantially planar, wherein said first longitudinal sidewall surface merges into said third longitudinal sidewall surface as a smooth curve, and wherein said second longitudinal sidewall surface merges into said fourth longitudinal sidewall surface as a smooth curve.

6. A flooring system in accordance with claim 2, wherein said capital portion has a vertical height which is approximately thirty to forty percent of an overall height of the floor beam.

7. A flooring system in accordance with claim 6, wherein at least one floor beam is provided with a holder for holding that floor beam upright during construction of the flooring system.

8. A flooring system in accordance with claim 1, wherein at least one floor beam is provided with a holder for holding that floor beam upright during construction of the flooring system.

9. A flooring system in accordance with claim 8, wherein the holder comprises a generally inverted U-shaped hook for securing the holder on the top end of an upstanding web of a foundation beam, said hook having a leg extending downwardly alongside an inner wall of that foundation beam, and a pair of generally horizontally extending lugs connected to said leg and being spaced apart from each other so that the end of a floor beam can be accommodated therebetween to stabilize that floor beam during subsequent construction of the flooring system.

10. A flooring system in accordance with claim 8, wherein said holder is a clip for engaging the column portion of the floor beam for holding the floor beam upright during construction of said flooring system.

11. A flooring system in accordance with claim 10, wherein each clip comprises first and second clip fingers and a linking member Joining a bottom end of said first clip finger to a bottom end of said second clip finger, the column portion of the floor beam being positioned on the linking member so that the first and second clip fingers resiliently grip opposite sides of the column portion of the floor beam.

12. A flooring system in accordance with claim 1, wherein the floor assembly includes a layer of thermal insulating material supported on the upwardly facing surfaces of the floor beams.

13. A flooring system in accordance with claim 12, wherein said thermal insulating material is a polymeric thermoplastic foamed material.

14. A flooring system in accordance with claim 12, wherein the floor assembly further comprises a layer of concrete cast in situ on said layer of thermal insulating material.

15. A flooring system in accordance with claim 12, wherein the floor assembly further comprises a layer of concrete which is preformed before being positioned on said layer of thermal insulating material.

16. A flooring system comprising:

first and second foundation beams arranged opposite each other, each foundation beam having a top surface and comprising an upstanding web having a top end and a bottom end, and at least one flange extending laterally from said bottom end of the upstanding web;

first and second floor beams, each of said first and second floor beams extending from said first foundation beam to said second foundation beam so that the first and second floor beams are supported by flanges on said first and second foundation beams each floor beam having a floor beam length and a generally T-shaped cross-sectional profile in a plane perpendicular to the floor beam length, each floor beam having a longitudinally extending capital portion and a longitudinally extending column portion with the capital portion having a width perpendicular to the floor beam length which is greater than a width of the column portion perpendicular to the floor beam length, said capital portion having an upwardly facing surface which is positioned below the top surfaces of the first and second foundation beams; and a floor assembly supported on the upwardly facing surfaces of the capital portion of the floor beams and having an upper surface positioned no higher than the top surfaces of the foundation beams.

17. A method in accordance with claim 16 wherein said third and fourth longitudinal sidewall surfaces of said column portion converge toward each other so that a width of said bottom longitudinally extending surface of said column portion is less than said width of said bottom of said capital portion.

18. A method in accordance with claim 17, wherein said first and second longitudinal sidewall surfaces have a rate of convergence which is greater than a rate of convergence of said third and fourth longitudinal sidewall surfaces.

19. A method in accordance with claim 16, wherein said top longitudinally extending surface and said bottom longitudinally extending surface are substantially parallel to each other.

20. A method in accordance with claim 16, wherein each of said first, second, third, and fourth longitudinal sidewall surfaces is substantially planar, wherein said first longitudinal sidewall surface merges into said third longitudinal sidewall surface as a smooth curve, and wherein said second longitudinal sidewall surface merges into said fourth longitudinal sidewall surface as a smooth curve.

21. A method in accordance with claim 16, wherein said capital portion has a vertical height which is approximately thirty to forty percent of an overall height of said structural beam.

* * * * *

UNITED STATES PATENT AND TRADEMARK OFFICE

CERTIFICATE OF CORRECTION

PATENT NO. : 5,729,940

DATED : March 24, 1998

INVENTOR(S) : BULLIVANT

It is certified that error appears in the above-identified patent and that said Letters Patent is hereby corrected as shown below:

Column 8, claim 11, line 12, delete "Joining" and insert --joining--.

Column 8, claim 16, line 42, delete "beams each" and insert --beams, each--.

Signed and Sealed this

Twenty-ninth Day of September, 1998

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,729,940

DATED : March 24, 1998

INVENTOR(S) : BULLIVANT

It is certified that error appears in the above-identified patent and that said Letters Patent is hereby corrected as shown below:

On the title page insert item [30],

--Foreign Application Priority Data, Nov. 19, 1994, U.K., 9423399.6--.

Signed and Sealed this

Fifteenth Day of August, 2000

*Attest:*

*Attesting Officer*

Q. TODD DICKINSON

*Director of Patents and Trademarks*